United States Patent [19]

Eberhardt, Jr.

[11] 4,001,536

[45] Jan. 4, 1977

[54] MICROWAVE OVEN CONTROLS

[75] Inventor: Mark Edward Eberhardt, Jr., Troy, Ohio

[73] Assignee: Hobart Corporation, Troy, Ohio

[22] Filed: Feb. 14, 1975

[21] Appl. No.: 549,922

[52] U.S. Cl. ..... 219/10.55 B; 219/10.55 M; 317/DIG. 2; 340/365 C

[51] Int. Cl.[2] ..... H05B 9/06

[58] Field of Search ..... 219/10.55 B, 10.55 C, 219/10.55 M, 453, 506, 492, 493; 317/DIG. 2; 340/337, 365 C, 365 S

[56] References Cited

UNITED STATES PATENTS

| | | | |
|---|---|---|---|
| 3,694,669 | 9/1972 | Witt et al. | 219/492 |
| 3,718,924 | 2/1973 | Trubert et al. | 219/506 |
| 3,736,445 | 5/1973 | Van Sickle | 317/DIG. 2 UX |
| 3,780,252 | 12/1973 | Crapuchettes | 219/10.55 B |
| 3,836,828 | 9/1974 | Siegel | 317/DIG. 2 |
| 3,846,791 | 11/1974 | Foster | 340/365 C |
| 3,852,728 | 12/1974 | Flagg, Jr. | 219/453 X |
| 3,862,354 | 1/1975 | Kawamata et al. | 317/DIG. 2 |
| 3,866,003 | 2/1975 | Fox | 219/10.55 B |
| 3,886,539 | 5/1975 | Gould, Jr. | 317/DIG. 2 |

*Primary Examiner*—Arthur T. Grimley
*Attorney, Agent, or Firm*—Biebel, French & Nauman

[57] ABSTRACT

A control for a microwave oven is disclosed in which cooking time is set by touching one of a number of touch plates on the oven control panel. An oscillator provides an asymmetric signal to a plurality of level detectors by way of the touch plates and associated circuitry. When a touch plate is touched by an operator, the resulting capacitance to ground acts to integrate the oscillator signal and prevent this signal from dipping below a predetermined minimum threshold level. This condition is sensed by the associated level detector and the timer is set accordingly. The oscillator is then disabled to prevent an accidental touching of one of the touch plates from affecting oven operation. Also disclosed is a power control circuit which switches on power to several magnetrons in a staggered manner to limit surge current.

12 Claims, 7 Drawing Figures

R91
CR33
R94
+15V
R93
154
C
U7
+15V
R31
R32
R33
U13
C
C13
Q2
110
R101
U13D
+15V
C100
CR35
R100
U9C
+15V
C18
139
150
147
+15V
R29
112
D
U7
R55
TP7
R68
R47
R
LED7
POT.
+15V
R90
120
B
U13
CR 28
R25
C9
Q3
+15V
CR27
U13
A
R46
R83
R92
CR26
R81
111
+15V
113
B
U7
R89
121
C
U12
CR 24
R24
C8
+15V
R67
TP6
R66
CR23
Q11
U12
D
R45
R74
R7
CR25
R80
LED6
147
139
+15V
114
A
U7
R88
+15V
122
B
U12
R23
CR 22
+15V
C15
C7
R64
TP5
R65
R30
CR21
Q10
CR 29
U12
A
R43
R73
R5
CR 20
150
R
R44
R79
142
143
LED5

+15V
R27
115
R87
123
R22
CR 18
CR17
C17
R13
143
142
147
R63
U6
D
U11
C
C6
Q9
TP4
R62
R42
R72
R4
R78
CR19
150
141
LED4
140
144
R86
124
R21
116
CR 16
CR30
R60
B
C5
CR15
TP3
Q8
R15
R61
R41
R40
R71
R6
R77
CR14
R
LED3
139
117
R85
125
R20
CR 12
R59
U10
C4
CR11
TP2
Q7
R58
R39
R82
R2
R76
CR13
LED2
130
118
R84
126
R26
CR 32
R56
C3
CR10
155
TP1
R57
R28
127
Q6
R37
R70
R1
R17
R38
R75
CR9
LED1
C10

+15V
R16
CR31
C11
146
160
U1
R8
CR1
145
RESET
AC-2
AC-1
COOK
CHASSIS
U5
U4
C2
C12
F1
142
141
140
147
144
130
A
U8
CR34
R12
148
C
C1
D
CR4
U9D
CR8
137
CR5
CR7
U9A
U9B
CR6
CR3
R11
Q4
Q5
Q6
Q7
U3
R
R35
CR2
K1
139
143
131

R10
C16
135
R19
B
U2
155
R36
Q1
136
R18
R3
R9

MICROWAVE OVEN CONTROLS

BACKGROUND OF THE INVENTION

This invention relates to timer circuits and power control circuits for electrical appliances and more particularly to control circuitry which is responsive to operator touch.

In microwave cooking appliances, the nature of the heating phenomenon is that of stressing certain of the molecules of the products to be heated by using an electromagnetic field, commonly in the heating frequency range of 2450 MHz. Such heating causes rapid cooking of food products and cooking time may typically be measured in seconds rather than hours and minutes as with more conventional cooking devices. It is important in such a device, therefore, to provide sufficiently accurate time control of the cooking cycle to insure that food is neither over-cooked nor undercooked. The environment in which microwave ovens are normally placed, however, such as a restaurant kitchen, has a deleterious effect upon control circuit operation. Moisture, food deposits, and grease build up on oven controls may cause a malfunction and presents a difficult cleaning problem.

One approach taken to solution of this problem has been the use of tough sensitive switches as controls. This allows for the control panel to be constructed as a smooth, easily cleaned plate having no moving parts. An example of such a control used with an oven-range combination is disclosed in U.S. Pat. No. 3,819,906. The touch sensitive circuit there disclosed is comprised of a plurality of level detectors, each detector connected to receive an oscillating signal from an associated "proximity switch" which includes a touch plate. When one of the touch plates is touched, a capacitor divider is formed which attenuates the signal being applied by the proximity switch to its associated detector. The detector senses the attenuation and switches its output signal.

Another principle of operation used in prior art touch sensitive circuits is disclosed in U.S. Pat. No. 3,492,440. That patent discloses a circuit in which the capacitance to ground of an operator completes a circuit and allows for an oscillator output to be applied to a level detector.

Touch sensitive circuitry used in the past has generally been susceptible to false actuations. Where the capacitance to ground of an operator is used to attenuate a signal or complete a circuit, there is a possibility of false actuation since a resistance to ground can also cause circuit actuation. The environment in which commercial microwave ovens operate is such that the possibility continually exists for grease and other foreign matter to form a resistance to ground from the various touch plates and thus cause the controls to malfunction.

SUMMARY OF THE INVENTION

In accordance with the present invention control circuitry for a microwave oven is provided having a high degree of immunity from false actuation resulting from foreign matter on the control panel. An oscillator means is provided to supply an oscillating signal simultaneously to a plurality of touch plate means. These touch plate means normally pass the oscillating signal unaltered but when touched modify the oscillating signal so as to increase the minimum voltage level to which the oscillating signal drops. A series of detector means are associated with and connected to the touch plate means and detect application of an oscillating signal having an increased minimum level. Timing means connected to each of the detector means enables the cooking cycle of the microwave oven for one of a plurality of predetermined time intervals in response to an indication by the detector means that one of the touch plate means has been touched. The oscillator means may typically supply an asymmetrical oscillating signal having a non-zero DC component to the touch plate means.

Accordingly it is an object of this invention to provide a touch responsive control circuit for a microwave oven in which the circuit is actuatable only when a capacitance is applied to the touch plates.

Other objects and advantages of the invention will be apparent from the following description, the accompanying drawings and the appended claims.

BRIEF DESCRIPTION OF THE DRAWINGS

FIGS. 3A, 3B, and 3C, when assembled, schematically represent a portion of the control circuit of the preferred embodiment;

FIG. 4 is a diagram indicating the manner in which FIGS. 3A–3C are to be assembled.

DETAILED DESCRIPTION OF THE PREFERRED EMBODIMENT

Figure 1:
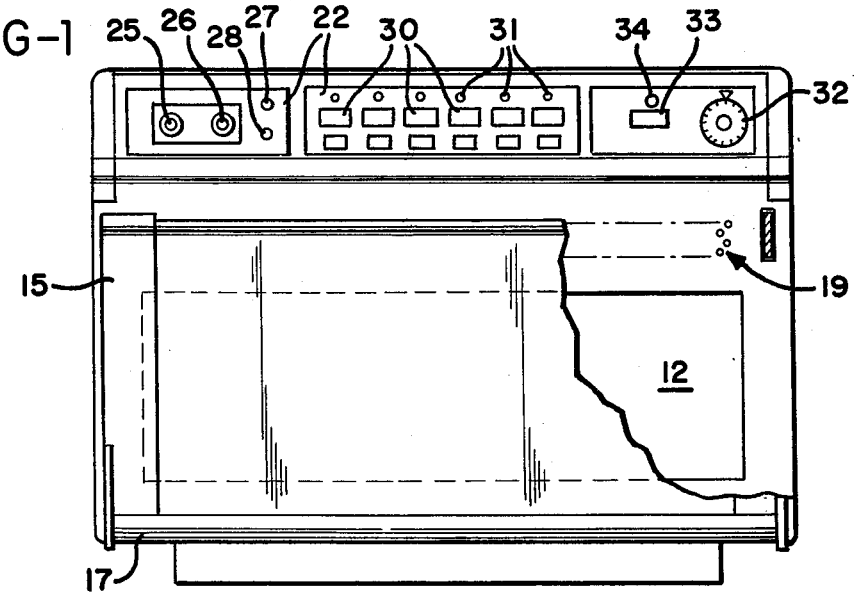
FIG. 1 is a front view of a microwave oven with a portion of the door broken away.

Referring now to FIG. 1, there is shown a front view of a microwave oven in which the control circuit of the preferred embodiment may be used. A cooking cavity 12 is covered by a door 15 which remains closed during the cooking operation so as to prevent the escape of microwave radiation. The door opens upwardly when handle 17 is raised to release the oven door latch mechanism. A plurality of vent holes 19 are provided to allow for the escape of steam during a cooking operation. Door 15 is shaped to permit gases to escape via holes 19 during the cooking cycle but holes 19 are of sufficiently small size that radiation leakage is prevented.

A control panel 22 includes OFF switch 25 and ON switch 26. Lamp 27 provides an indication that the oven is cooking and lamp 28 indicates that power is being supplied to the oven and its control circuitry. A number of touch plates 30 consisting of metallic plates mounted flush with the control panel are provided. Each plate is connected to an associated touch sensing circuit which, when activated, initiates the cooking operation. Timing circuitry terminates the cooking operation after an interval of time which is unique to the sensing circuit activated. When a touch plate and associated sensing circuit activate the oven so as to cause it to cook for a preset interval, operation for that interval is indicated by an associated one of light emitting diodes 31 being turned on. Control panel 22 is substantially flat so as to be easily cleaned. Also mounted on the control panel is a dial 32 which may be set by a user to any desired time interval. Touch plate 33 may be used to initiate a cooking cycle for the time period set on dial 32 and light emitting diode 34 will indicate that such an operation is taking place.

Figure 2:
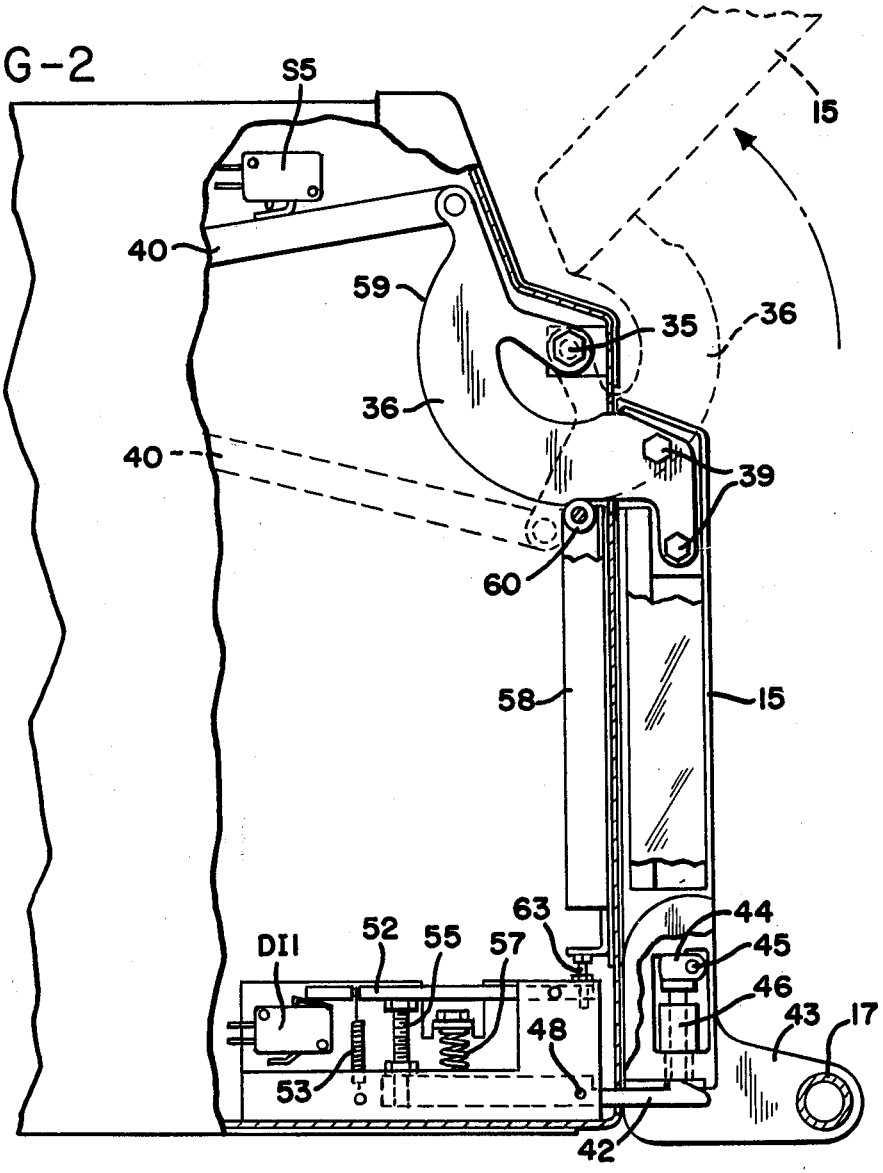
FIG. 2 is a partial side view of the oven with parts of the exterior structure broken away to reveal the oven interlock arrangement.

Referring now to FIG. 2 there is shown a side view of a microwave oven using the control circuit of the preferred embodiment and having portions of the cabinet and door structure broken away to reveal the latch mechanism and the interlock switches. As shown by the dash lines, oven door 15 opens upwardly and rotates about bolt 35 which is connected to a hinge plate 36. Hinge plate 36 is fixed to door 15 by studs 39. An over-center linkage arrangement (not shown) is connected to link 40 to aid in opening and closing the oven door. The door is latched closed by striker 42 which engages a notch in the bottom of the door. It is to be understood that a hinge, latch, and interlock as shown in FIG. 2 is located at both ends of the door. When the door is to be opened, handle 17 is lifted and, since plate 43 is attached to cam 44, the cam rotates on an axis about screw 45 and depresses plunger 46. This causes striker 42 to pivot about pivot 48 with the result that the door is unlatched.

Figure 5:
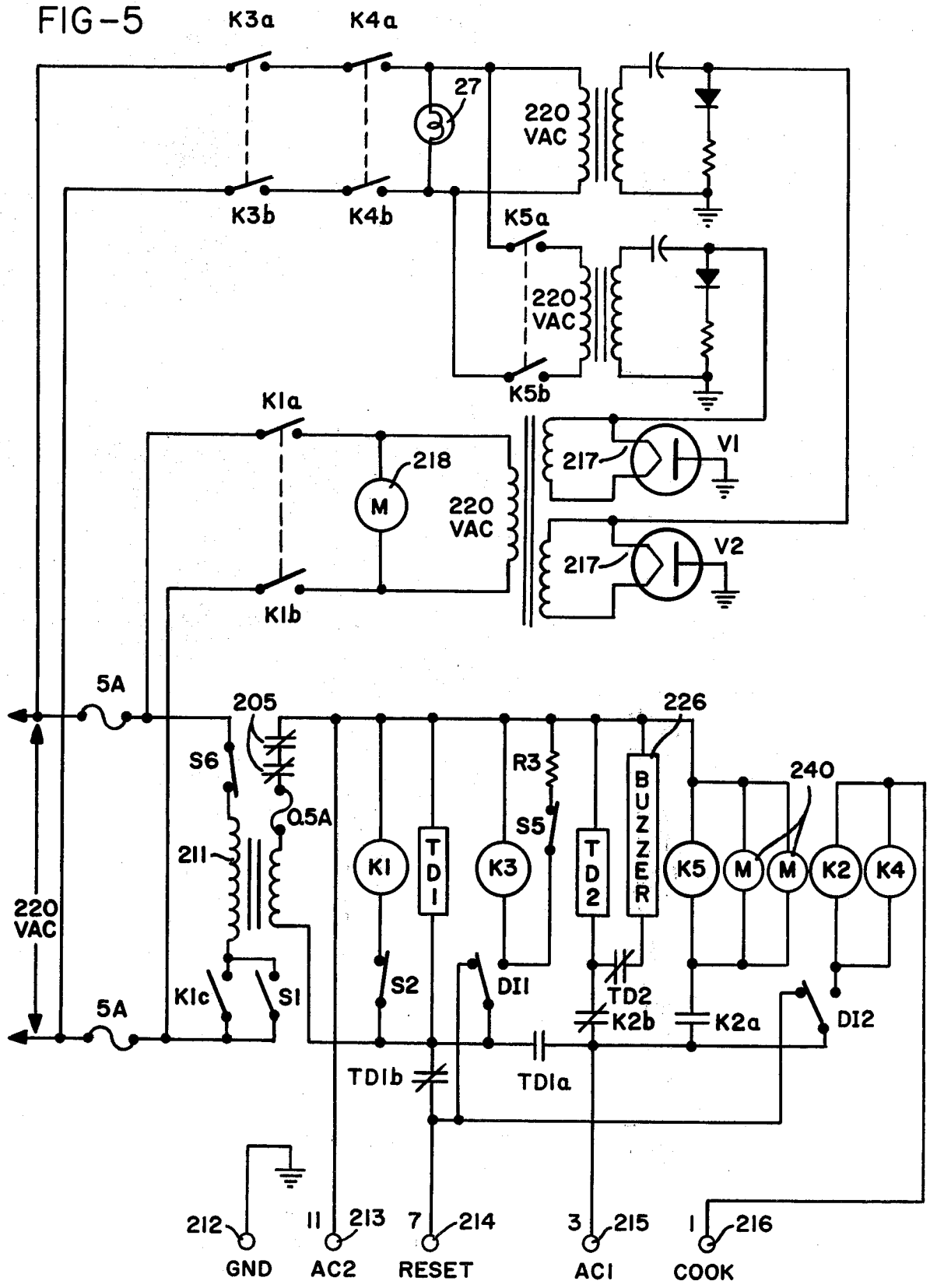
FIG. 5 is a schematic representation of the power control circuit of the preferred embodiment.

Switch DI1 is provided to sense the unlatching of the door or the opening of the door and to provide this information to the power control circuit of FIG. 5. When the door is closed and latched, an actuator bar 52 is biased by spring 53 into a horizontal position with the back end of the bar resting on switch DI1. Either unlatching the door or opening the door causes the actuator bar to be raised off switch DI1. When the door is unlatched, the rotation of striker 42 causes bolt 55 to raise the actuator bar off switch DI1 against the downward spring force of spring 57. After the door is opened, spring 57 causes the striker 42 to return to its normal horizontal position. The actuator bar 52 is prevented from contacting switch DI1 when the door is opened, however, by plunger 58. Hinge 36 has a cam surface 59 upon which rides roller 60. When the door is opened, roller 60 moves plunger 58 downward, depressing bolt 63 and preventing any contact between the actuator bar 52 and switch DI1 as long as the door is open. Opening of the door is also monitored by means of switch S5 which engages link 40 only when the door is completely closed.

Figure 3A:
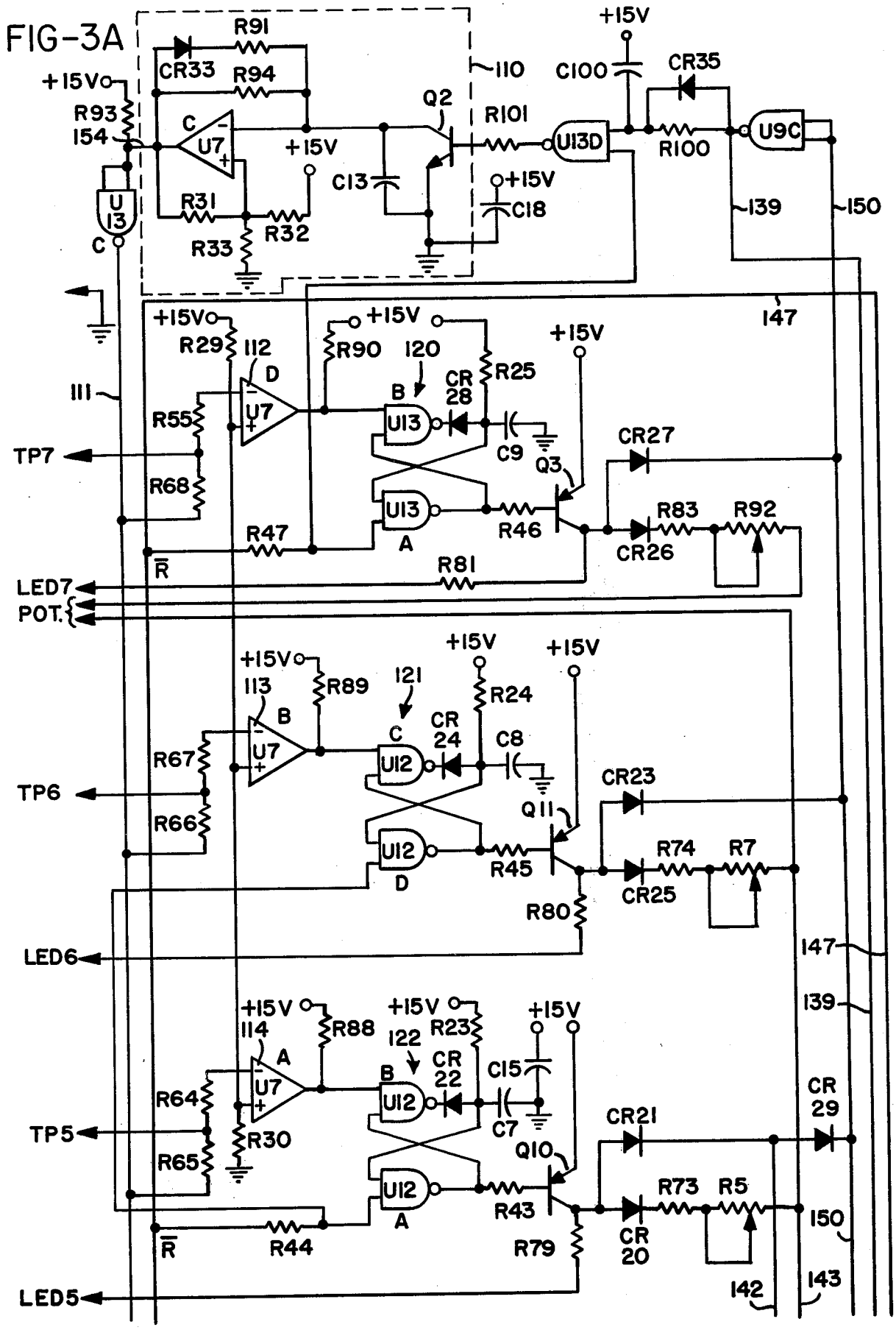
Figure 3B:
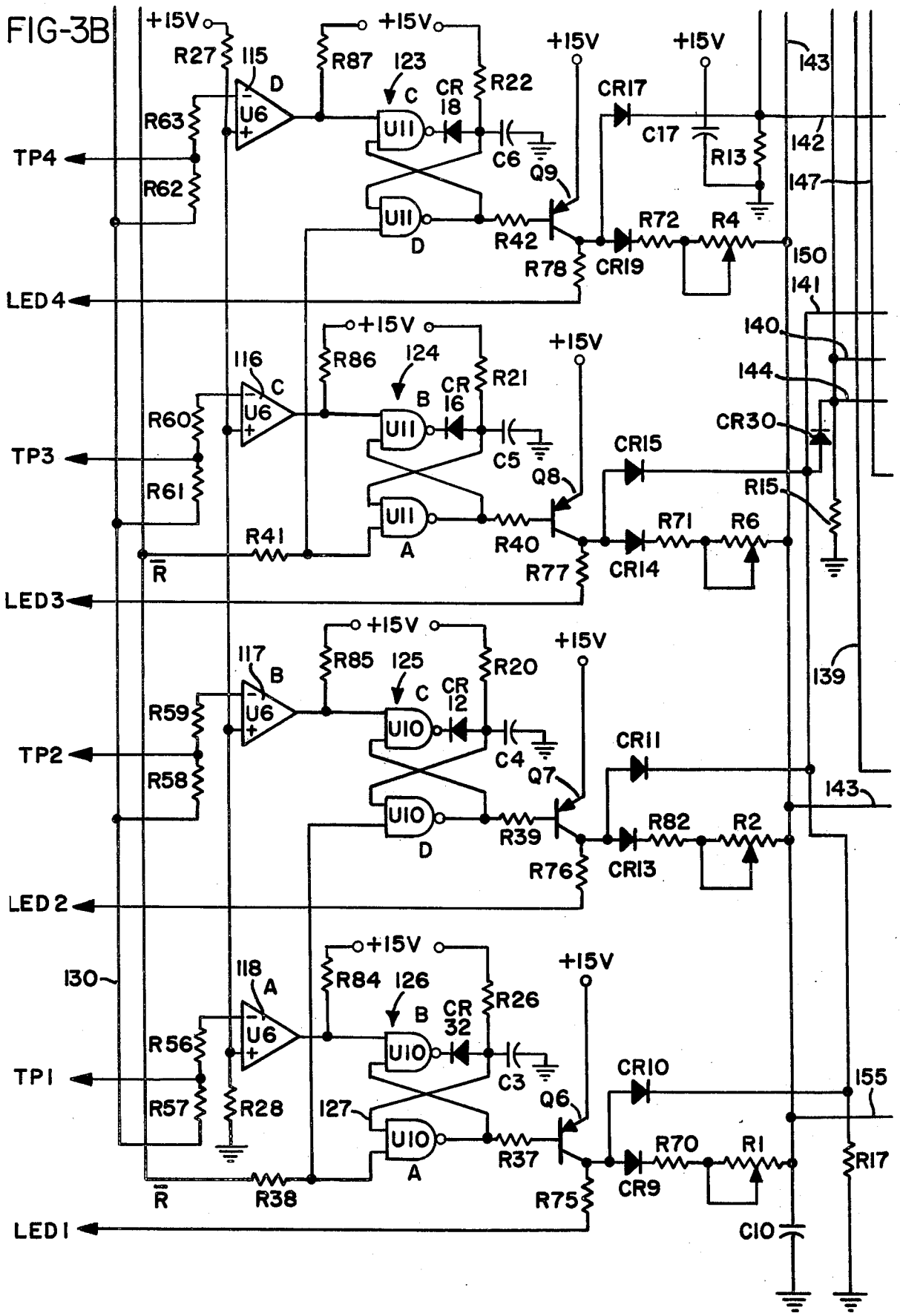
Figures 3A, 3B, 3C, 4:
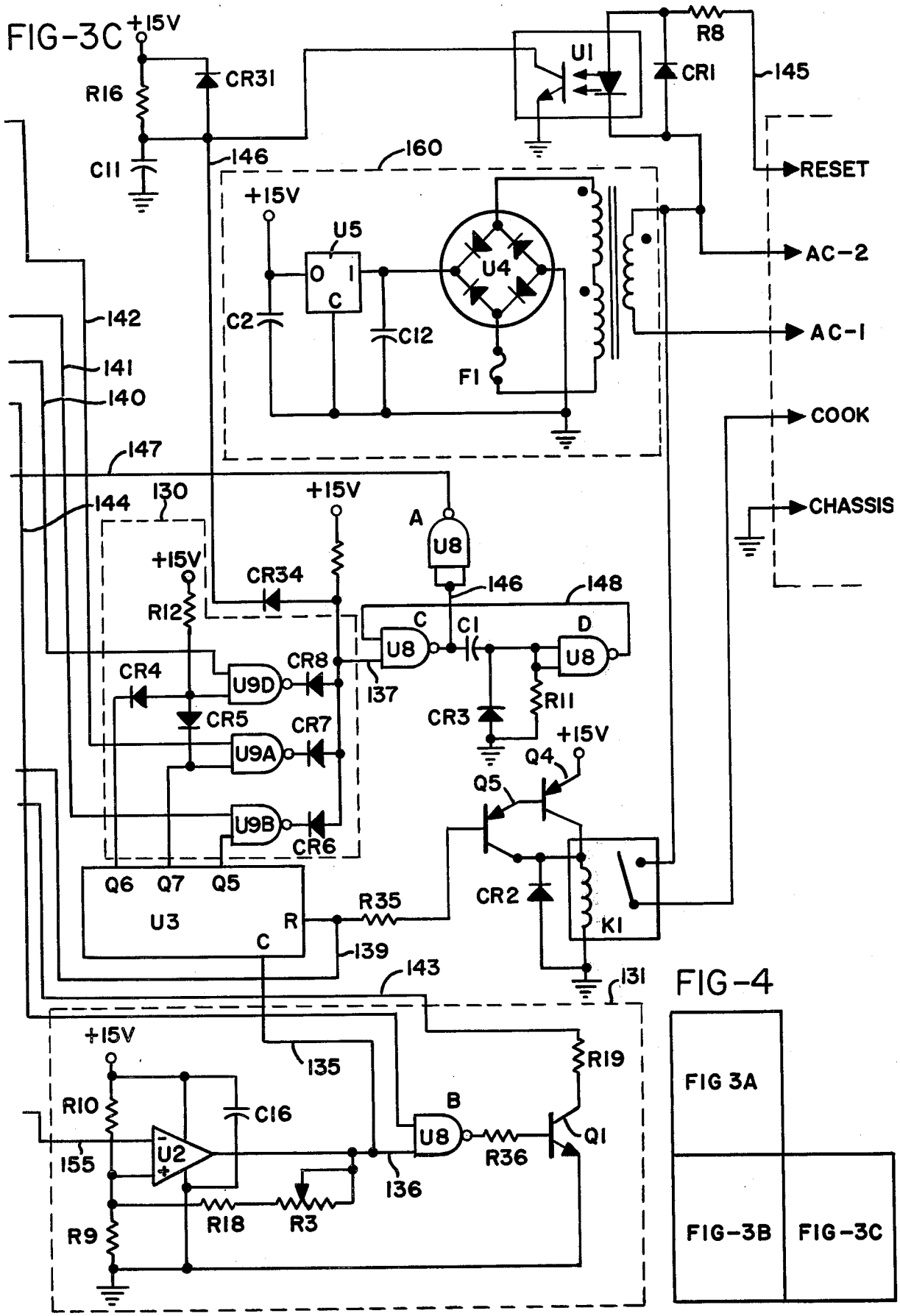

FIGS. 3A, 3B, 3C, when assembled as shown in FIG. 4, illustrate part of the control circuit of the preferred embodiment of the invention. Connection is made to the power control circuit shown in FIG. 5 via the lines labeled RESET, AC-2, AC-1, COOK and CHASSIS. The circuit comprises an oscillator means 110 for providing an oscillating signal which alternates between two voltage levels. This signal is applied to a plurality of touch plate means or touch responsive filter means by line 111. Lines TP1, TP2, TP4, TP5, TP6, and TP7 are connected to the touch plates on the control panel. Detector or comparator means comprise comparator circuits 112–118 which are each connected so as to receive a first input from an associated touch plate and to compare this input with a reference voltage applied to the positive input of the comparator. The comparators are connected to a timing circuit comprising bistable means 120–126. These bistable means are flip-flops composed of two complementary output MOS NAND gates connected so as to change state only after a time delay. The output of each of the flip-flops is connected to switch on one of the transistors Q6–Q11 or Q3 and thereby determine the cooking time of the oven, as will be described below.

The circuitry associated with each touch plate is identical and therefore will be described only with relation to touch plate 1. Oscillator 110 provides a pulse train on line 111 which alternates between 15 volts and zero volts. It has been found, as explained below, that an asymmetric pulse train which is high the majority of the time will provide improved operation. The pulse train may, for instance, be a 100 KHz pulse train alternating between 15 volts (8.5 microseconds) and zero volts (1.5 microseconds). Comparator 118 is a standard comparator, available from a number of suppliers such as Motorola Semiconductor Products, Inc., Phoenix, Ariz., as integrated circuit 3302. This device supplies a high signal on its output when its positive input is at a potential greater than its negative input and supplies a low signal on its output when its negative input is at a potential greater than its positive input. The positive input terminal of comparator 118 is connected to a voltage divider including resistors R27 and R28 which provides a 7.5 volt D.C. signal. When the 100 KHz signal alternating between 0 and 15 volts is applied to the negative input of comparator 118, the comparator output will be a 100 KHz pulse train with positive pulses being 1.5 microseconds in duration. Since NAND gate U10A normally has a high output, the output of NAND gate U10B will be periodically switched low in response to this pulse train. This will be sufficient to maintain capacitor C3 in a discharged condition with the result that a low input is applied to line 127 and NAND gate U10A will maintain transistor Q6 in an off condition.

When the touch plate is touched, a capacitance is effectively connected between line TP1 and ground. This added capacitor causes the touch plate means to act as a low pass filter or integrator with the result that the negative input to comparator 118 is not allowed to drop below the threshold level of 7.5 volts. The output of comparator 118 is therefore maintained at a low level while the touch plate is touched. A low input to NAND gate U10B causes its output to go high and allows capacitor C3 to charge. When this occurs, NAND gate U10A receives high signals on both its inputs and its output goes low, switching on transistor Q6. This causes a signal to be applied to line LED1, lighting the light emitting diode associated with touch plate 1 on control panel 22.

The timing interval for a cooking cycle is determined by switching one of transistors Q6–Q11 and Q3. Oscillator 131 provides a pulse train on line 135 which is counted in counter U3 to a predetermined count. The counter output is monitored by decoder 130 which supplies a low signal on line 137 indicating that counter U3 has reached the predetermined count and that the cooking cycle is to be terminated. When one of transistors Q6–Q11 and Q3 is switched on, the timing interval is affected in two ways. A charging path for capacitor C10 is provided through one of resistors R70–R74, R82 or R83. The charging time of capacitor C10 determines the output frequency of oscillator 131. Second, diodes CR10, CR11, CR15, CR17, CR21, CR23, and CR27 provide signals on lines 140–142 which determine the predetermined count to be detected by decoder 130.

Switching on one of transistors Q6–Q11 and Q3 has two other effects—it initiates the cooking cycle of the oven and it terminates the operation of oscillator 110. The oven begins cooking when line AC2 is connected to the COOK line by reed relay K1. This occurs as a result of line 139 going low which in turn occurs when line 150 goes high. The potential on line 150 goes high when one of diodes CR10, CR11, CR15, CR17, CR21, CR23, or CR27 is forward biased as one of transistors Q6–Q11 and Q3 is switched on. Line 139 going low also causes the output of U13D to go high after a time delay determined by capacitor C100 and resistor R100. This delay is provided to insure that flip-flops 120–126 will have sufficient time to latch completely. When the output of U13D goes high after the delay, transistor Q2 is switched on and operation of oscillator 110 is terminated. Termination of the operation of oscillator 110 effectively prevents any of the touch responsive means from thereafter being enabled and thus prevents an accidental touching of a touch plate while the oven is cooking from affecting oven operation.

Oscillator 131 functions as follows. The comparator U2 is a standard operational amplifier, available from a number of suppliers such as Motorola Semiconductor Products, Inc., Phoenix, Ariz., as integrated circuit 741. This circuit has the characteristic that when its negative input exceeds its positive input, its output goes low, and when its positive input exceeds its negative input, its output goes high. Initially, the plus input of U2 will be approximately 10 volts as a result of the voltage divider arrangement of the resistors R10, R9, R18, and R3. R3 is provided to allow for fine adjustment by a technician when the device is being serviced. Operation of the oscillator begins when transistor Q1 is switched off in response to the high signal on line 144 which causes the output of U8B to go low. Capacitor C10 will therefore charge through one of the resistances selected by the corresponding touch responsive circuit to a voltage slightly greater than 10 volts. The output of U2 will then go low and as a result, the positive input of U2 will receive a lowered voltage, approximating 5 volts, from the voltage divider. Simultaneously, NAND gate U8B will receive a low signal on line 136, supplying a high signal to the base of transistor Q1, switching transistor Q1 on, thus allowing capacitor C10 to discharge through resistor R19. When capacitor C10 discharges to a voltage slightly less than 5 volts, the output of comparator U2 again goes high, the output of U8B goes low, transistor Q1 is switched off, and C10 is allowed to recharge. Thus, it is seen, the oscillator frequency is determined by the charging time of capacitor C10 which is directly controlled by the charging current and hence by the resistance placed in the charging path. Resistors R1, R2, R4–R7 and R92 provide a means for a technician to adjust the resistance in each charging path to a precise level. It is also possible to insert a user adjustable potentiometer, such as indicated on the output of R92, to allow an infinite number of cooking intervals to be selected during normal operation of the oven.

The pulse train output of oscillator 131 is supplied to counter U3 on line 135. Counter U3 is a simple binary counter with the Q5 output corresponding to the $2^4$ place. The Q6 and Q7 outputs correspond to the $2^5$ and $2^6$ places, respectively. The R input of counter U3 is the reset input and causes the counter to reset to zero whenever a high signal is received on line 139.

Decoder 130 monitors the Q5, Q6, and Q7 outputs of the counter U3 and provides an indication when the counter U3 has received a preselected number of pulses from oscillator 131. The decoder is arranged so that the number to be detected is set by means of a positive signal on one of lines 140, 141, or 142. When line 141 goes high, the decoder will terminate the timing period after the counter U3 supplies a high output on Q5, indicating that a count of 16 has been reached. When a positive signal is applied to line 142, the decoder 130 will detect when a count of 64 has been reached. A high signal on line 140 effectively enables NAND gate U9D. This NAND gate then has a low output whenever both the Q6 and Q7 counter outputs are high. Thus, a high signal on line 140 will cause the decoder 130 to sense when counter U3 has reached a count of 96.

As mentioned previously, a low output on line 137 effectively ends the timing period. The timing period may also be terminated when a reset signal is received from the power control circuit (to be later described) on line 145. Such a signal causes optoisolator U1 to ground line 146 and thus terminate the timing circuit operation.

During a timing cycle line 137 is high and since the input of NAND gate U8C on line 148 is also high, its output will be low. This low output on line 146 is inverted by NAND gate U8A and supplied to each of the touch responsive circuits as an inverted reset signal $\overline{R}$ via line 147. A low signal is supplied to NAND U8D by resistor R11 and inverted so as to provide a signal on line 148 which locks gate U8C to a low output. When line 137 goes temporarily low at the end of timing cycle, line 146 is switched high. The voltage across capacitor C1 cannot change instantaneously and therefore the input to U8D immediately goes high with the result that line 148 supplies a low input to gate U8C. Gate U8C will continue to have a high signal on its output as a result of the low signal on line 148, regardless of any subsequent changes in the voltage on line 137. After a period of time determined by the (R11) and (C1) time constant, capacitor C1 will charge and the output of NAND gate U8B will go high. Thus, capacitor C1 and resistor R11 insure that the reset signal on line 147 is maintained for a predetermined length of time.

This reset signal on line 147 acts to reset whichever flip-flop had been set at the beginning of the timing interval. Lines 140–142 are therefore deenergized. Line 150 goes low, the output of NAND gate U9C on line 139 goes high and counter U3 is reset. The reset signal on line 139 also acts to open relay K1 by turning off transistors Q4 and Q5. This disconnects line AC2 from the COOK line and the cooking cycle is terminated by the power control circuit. When line 139 goes high and the inverted reset signal $\overline{R}$ goes high after the reset operation, the output of NAND gate U13D will go low and cause transistor Q2 to switch off. Since diode CR35 by-passes resistor R100, no delay will be provided by the (R100) (C100) combination. After transistor Q2 switches off, oscillator 110 will resume operation and a new cooking cycle may be initiated. Oscillator 110 will then resume operation. A new cooking cycle may now be initiated.

Oscillator 110, when activated by transistor Q2 being switched off, operates as follows. U7C is a comparator identical to the comparators 112–118. Assuming that its output 154 is initially high, a voltage divider arrangement consisting of resistors R31, R32, and R33, supplies a voltage of approximately 10 volts to the comparator input. Capacitor C13 is then charged through resistors R91 and R94 until its voltage slightly exceeds 10 volts. When this occurs, the output of U7C goes low and the voltage divider consisting of R31, R32, and R33 supplies a plus 5 volt potential to the positive input of comparator U7C. Capacitor C13 then discharges only through resistor R94 until the voltage across it drops to slightly less than 5 volts. The comparator output will then go high and the charging cycle of capacitor C13 will begin again. It is seen therefore that the oscillator output on line 111 will be asymmetric as a result of resistor R91, R94, and diode CR33. Capacitor C13 will have a charging path which is different from its discharge path and therefore its charging time will be shorter than its discharge time.

It has been found that the use of an asymmetric oscillator signal enhances the operation of the touch plate means and associated circuitry. It is of course possible to utilize a symmetric pulse train since the low pass filter action of a touch plate means will raise the minimum level to which such a pulse train will drop. By using a pulse train with a high D.C. component, however, this filtering action is accentuated. The comparators may therefore use a higher reference voltage and erroneous actuation of a touch responsive circuit is thus made less likely.

Circuit 160 provides the +15 volt D.C. supply utilized by the control circuit. It may contain a standard voltage regulator U5. A number of decoupling capacitances such as C18 are connected between the D.C. supply and ground to eliminate noise on the supply output.

The following is a table of typical values for the circuit of FIG. 3.

| Component | Value |
|---|---|
| R1 | 20KΩ trim pot. |
| R2–R5 | 50KΩ trim pot. |
| R6, R7 | 100KΩ trim pot. |
| R8 | 10KΩ ± 10%, 2W Carbon Resistor |
| R9–R17 | 100KΩ ± 5%, ¼W Carbon Resistor |
| R18, R94 | 82KΩ ± 5%, ¼W Carbon Resistor |
| R19 | 100Ω ± 5%, ¼W Carbon Resistor |
| R20–R33 | 47KΩ ± 5%, ¼W Carbon Resistor |
| R35–R47, R55–R68 | 27KΩ ± 5%, ¼W Carbon Resistor |
| R70 | 5.6KΩ ± 5%, ¼W Carbon Resistor |
| R71 | 15KΩ ± 5%, ¼W Carbon Resistor |
| R72 | 9.1KΩ ± 5%, ¼W Carbon Resistor |
| R73 | 12KΩ ± 5%, ¼W Carbon Resistor |
| R74 | 18KΩ ± 5%, ¼W Carbon Resistor |
| R75–R81 | 680Ω ± 5%, ½W Carbon Resistor |
| R82–R91 | 10KΩ ± 5%, ¼W Carbon Resistor |
| R92 | 5KΩ Trim Pot. |
| R93 | 1KΩ ± 5%, ½W Carbon Resistor |
| R100 | 100KΩ ± 5%, ¼W Carbon Resistor |
| R101 | 27KΩ ± 5%, ¼W Carbon Resistor |
| POT. | 100KΩ Potentiometer |
| CR1, CR2 | DIODE |
| CR3–CR35 | Schottky Diode |
| C1, C2, C15–C18, C100 | .1μfd. Ceramic Capacitor |
| C3–C9 | .01μfd. Ceramic Capacitor |
| C10 | 70μfd. Tantalum Capacitor |
| C11 | 2.2μfd. Tantalum Capacitor |
| C12 | 200μfd., 50V Capacitor |
| C13 | 100pfd. ± 5% Silver Mica Capacitor |
| T1 | 20V, 220 Ma. Transformer |
| F1 | 500 Ma. Fuse |

Referring now to FIG. 5 of the drawings there is shown a schematic of the power control circuitry for a microwave oven utilizing the interlock of the present invention and having magnetrons V1 and V2. Switch S1 is the ON push button switch (normally open) and switch S2 is the OFF push button switch (normally closed), both of which are located on the oven control panel. Switch S6 is a safety switch located within the oven cabinet and opens to prevent oven operation only when the cabinet cover is removed. Switch S5 (normally open) is located on the over-center linkage of the oven door as shown in FIG. 2 in such a manner as to close when the door is opened. Switches 205 are thermally responsive and will open to prevent overheating of the magnetrons V1 and V2. The switches DI1 and DI2 correspond to the door interlock switches described in FIG. 2 and are arranged to be switched to their right position when the oven door is closed and to their left position when the oven door is opened. Nodes 212–216 are connected to the timer circuit as indicated in FIG. 3.

Power control circuit operation is initiated when ON switch S1 is momentarily closed with the result that power is supplied to the secondary of transformer 211. Relay coil K1 is energized and contacts K1*a*, K1*b*, and K1*c* are closed, locking the circuit on and supplying power to the magnetron heater filaments 217 and the blower motor 218. Timer TD1 is simultaneously activated and goes through a 10 second delay, allowing the magnetron heater filaments 217 sufficient time to become properly heated. Providing that the oven door is closed, relay coil K3 is also energized through switch DI1 with the result that contacts K3*a* and K3*b* on the primary of the magnetron power circuit are closed. During this initial warm-up period, a reset signal on line 214 is applied to timer circuit to prevent initiation of timer operation.

At the end of the 10 second delay of timer TD1, contacts TD1*a* are closed and power is supplied to buzzer 226 indicating that a cooking cycle may now be initiated. The reset signal on line 214 is terminated by the opening of contacts TD1*b*. Timer TD2 is activated simultaneously with the buzzer 226 to terminate buzzer operation after a short period of time by opening contacts TD2.

The timer circuit may then initiate a cooking cycle by connecting line 213 to line 216. As discussed above, this connection is maintained for a period of time set by means of the touch responsive switches on the oven control panel. Power is thus supplied to relay coil K4 by the timer circuit through switch DI2. This closes contacts K4*a* and K4*b* and magnetron V2 begins operation. Lamp 27 lights to indicate this condition. Relay coil K2 is also energized, closing contacts K2*a*, to supply power to coil K5 and stirrer motors 240 a fraction of a second after power is supplied to relay coil K4. Contacts K5*a* and K5*b* are therefore closed and magnetron V1 is activated slightly after magnetron V2. This staggered initiation of magnetron operation is provided to prevent excessive surge currents which might result if both magnetrons were switched on simultaneously.

The duration of the cooking operation is controlled by the timer circuit. At the conclusion of the cooking cycle, power is removed from relay coils K2 and K4, thus opening contacts K2*a*, K4*a*, K4*b*, K5*a*, and K5*b*. Contacts K2*b* are closed, causing the buzzer 226 to sound for the timer period determined by timer TD2 to indicate that the cooking operation is completed.

It is clear that if either of the interlock switches DI1 or DI2 are switched to their left position, indicating the opening or unlatching of the oven door during the cooking cycle, power will be immediately removed from both magnetrons by the opening of either contacts K3*a* and K3*b* or contacts K4*a* and K4*b*. Switch S5, which is mounted on the over-center oven door linkage, is used to monitor the operation of interlock switch DI1 and guard against its malfunction. If switch DI1 is defective and, as a result, assumes its right switch position when the door is opened, switch S5 will allow current to flow through resistor R3. Since this resistance is only 1.5 ohms, the 0.5 amp fuse in the secondary of transformer 211 will be blown. The oven will therefore become inoperable and will remain so until repaired.

While the method herein described, and the form of apparatus for carrying this method into effect, constitute preferred embodiments of the invention, it is to be understood that the invention is not limited to this precise method and form of apparatus, and that changes may be made in either without departing from the scope of the invention.

What is claimed is:

1. A control circuit for controlling the operating cycle of an appliance comprising:

oscillator means for providing an oscillating signal which alternates between two voltage levels, a plurality of touch plate means receiving said oscillating signal, each said touch plate means providing said oscillating signal at its output when untouched and providing at its output a modified oscillating signal when touched, said modified oscillating signal having an increased minimum voltage level, detector means connected to the outputs of said plurality of touch plate means for detecting application of an oscillating signal having an increased minimum voltage level, and timing means connected to said detector means for setting the operating cycle of said appliance in response to the touching of one of said plurality of touch plate means.

2. The control circuit of claim 1 in which said oscillating signal is at the larger of said two voltage levels the majority of the time.

3. A control circuit for controlling the operating cycle of an appliance comprising:

oscillator means for supplying an alternating signal having a non-zero D.C. component and an A.C. component, touch responsive low pass filter means connected to said oscillator means for supplying said alternating signal at its output when untouched and for filtering said alternating signal and providing a filtered alternating signal at its output when touched, and detector means for detecting the receipt of a filtered oscillating signal.

4. A control circuit for controlling the operating cycle of an appliance comprising:

oscillator means for providing an oscillating signal having an A.C. component and a non-zero D.C. component, detector means responsive to the application of said D.C. component and a substantially attenuated A.C. component to set the operating cycle of the appliance and responsive to the application of said oscillating signal or to no signal not to set the operating cycle of the appliance, and touch plate means for supplying said oscillating signal to said detector means when untouched and for supplying said non-zero D.C. component and a substantially attenuated A.C. component to said detector means when touched.

5. An appliance control circuit comprising:

oscillator means for providing an oscillating signal which alternates successively between two voltage levels, comparator means for comparing a signal supplied to an input to a reference voltage and for providing an output signal when said signal supplied to said input exceeds said reference voltage, touch responsive means for supplying said oscillating signal to said comparator when said touch responsive means is untouched by an operator and for supplying to said comparator means a filtered oscillating signal which continuously exceeds said reference voltage when said touch responsive means is touched by an operator, and circuit means for controlling appliance operation in response to the application of said output signal from said comparator means for a predetermined period of time.

6. A control circuit as recited in claim 5 in which said circuit means comprises bistable means switchable to a state enabling operation of the appliance upon receipt of said first output signal for a length of time exceeding the period of said oscillating signal.

7. The circuit of claim 6 further comprising lock-out means for preventing said oscillator means from operating after said bistable means changes state whereby said touch responsive means is disabled.

8. In an appliance control circuit, the method of circuit actuation in response to the touch of an operator, comprising the steps of:

supplying a reference signal and an oscillating signal to a comparator, said comparator providing a control circuit actuating signal when said oscillating signal exceeds said reference signal for a predetermined duration, and filtering said oscillating signal with a touch plate filter circuit when body capacitance is added to make the filter effective, said filtering maintaining said oscillating signal at a level greater than said reference signal for said predetermined duration.

9. The method of claim 8 in which said oscillating signal alternates between a zero voltage level and a non-zero voltage level and is at said non-zero voltage level the majority of the time.

10. A method of actuating a timer circuit for an appliance by sensing the touching of a touch plate on the appliance control panel comprising the steps of:

supplying an oscillating signal having a non-zero direct current component and an alternating current component to a detector means which actuates the timer circuit on receipt of substantially only said direct current component, and filtering said oscillating signal with a filter circuit which incorporates the touch plate to substantially reduce said alternating current component only when body capacitance is added to make said filter circuit effective.

11. The method of electrically sensing the touching of a touch plate comprising the steps of:

applying to the touch plate a signal having an A.C. component and a D.C. component from an oscillator, said signal alternating between a first higher voltage level and a second lower voltage level and being at said first higher level the majority of the time, and sensing the increased capacitance to ground at said touch plate and the resulting change in said signal in response to a person touching said touch plate such that said signal does not drop to said second lower voltage level as the A.C. component of said signal is attenuated.

12. The method of claim 11 wherein said first higher voltage level is non-zero and said second lower voltage level is substantially zero and whereby a resistance to ground from said touch plate will result in a signal at said touch plate which alternates between zero volts and a voltage level intermediate said first and second voltage levels and erroneous sensing of a touch will not occur.

* * * * *